US006405466B1

(12) United States Patent
Lemire

(10) Patent No.: US 6,405,466 B1
(45) Date of Patent: Jun. 18, 2002

(54) SELF-LEVELING AND CONVERTIBLE PICTURES

(76) Inventor: Robert Lemire, P.O. Box 299, Kings Park, NY (US) 11754

( * ) Notice: Subject to any disclaimer, the term of this patent is extended or adjusted under 35 U.S.C. 154(b) by 0 days.

(21) Appl. No.: 09/798,046

(22) Filed: Mar. 5, 2001

(51) Int. Cl.[7] ..... A47G 1/18
(52) U.S. Cl. ..... 40/757; 248/493
(58) Field of Search ..... 40/757, 746; 248/493, 248/496

(56) References Cited

U.S. PATENT DOCUMENTS 558,548 A * 4/1896 Cave ..... 248/493
822,048 A * 5/1906 Horinko ..... 248/493
980,295 A * 1/1911 Lee ..... 248/493
1,043,448 A * 11/1912 Marshcall ..... 248/493
2,632,971 A * 3/1953 Manczek et al. ..... 40/746
2,661,560 A * 12/1953 Malby ..... 40/575

* cited by examiner

*Primary Examiner*—Cassandra H. Davis

(57) ABSTRACT

Pictures and picture backs that provide a self-leveling picture support for a stable wall hanging. The back is designed for the easy removal of an easel flap and its holder. The back also has a series of holes for a cord to be looped through so that two loops can be used when hanging the picture on a wall. The cord is able to slide and allow the picture to be hung perfectly level. The easel flap is designed to be a template for the screws in the wall. This allows the screws to be installed at the proper location on the wall. The cord loops allow the picture to be positioned until it is level by having on loop get shorter while the other loop gets longer. The easel holder can be removed and is stored in a slot at the bottom of the back. This keeps all the components together and helps to keep the picture stable and parallel to the wall.

4 Claims, 4 Drawing Sheets

Section A-A

SELF-LEVELING AND CONVERTIBLE PICTURES

FIELD OF THE INVENTION

The invention concerns pictures with picture backs that are applied to a picture frame. Many of these picture backs have a movable flap, called the easel, that swings away from the plane of the picture and allows the picture to be supported in a tilled position while on a surface.

These picture backs often have a means for attaching the picture to a wall with a nail or a hooks. The picture backs are customarily made of chipboard and are either painted black or covered with a black felt.

BACKGROUND OF THE INVENTION

Pictures with easel picture backs perform well when being supported on a surface; however, they are a source of frustration when hanging them onto a wall. Even pictures without the easels rarely hang in a desired position without tilting.

Picture backs with an easel flap are almost impossible to have the picture parallel to the wall. The picture usually tips to one side unless the easel and the easel holding bracket are removed from the picture back. In addition to this, the picture rarely stays level on the wall. This is because of the off center load that the easel imparts on the picture. No consideration has been given to the locating of a hanging point that will hold the picture level on the wall. The wall hanging devices provided with these backs are usually placed in the middle of the picture back instead of at their center of gravity. Some picture backs attempt to counter this problem with a sawtooth hanger. Even this method rarely solves the problem.

The current invention is an outgrowth of trying to hang pictures with these picture backs on the wall. The first thing that is done with easel back pictures is the removal of the easel flap and the hardware attaching it to the back. The next task is to attach a cord to the picture back and use that to hang the picture. This led to the inventing of a back that uses a double loop cord for hanging on a wall and has a removable easel.

This invention has a double loop cord that is free to slide between the two ends of the cord. This allows the two loops to become adjusted to the exact position where the picture is level. Having the two loops also holds the picture so that it is stable and doesn't change position due to vibrations or incidental contact.

The removable easel simply slips into a holder that in turn slips into a middle angled slot in the picture back. When in the middle slot the easel is used to hold the picture in a tilted fashion on a surface. When the easel is removed from the holder it is used to provide a template for locating the screws that go into the wall and support the picture. The screws go through two holes in the easel and hold the easel so that it stays with the picture in the event that the picture is taken off the wall and moved to a surface. The picture back also has two additional slots for holding the easel holder on the bottom of the picture when the picture is hung on the wall. The combination of the two screws on the top and the easel holder on the bottom make the picture stable on the wall by providing a three point system. It also keeps all of the components together when the picture is on the wall.

SUMMARY OF THE INVENTION

This invention combines an adjustable cord with a removable easel on the traditional easel back picture frame. It is composed of a traditional picture back that has been altered to use a cord for hanging the picture onto a wall and a removable easel flap and easel holder. The use of a cord with double loops allows the picture to be leveled and held stable when hung on a wall. The removable easel is further used to provide additional help for holding the picture in a desired position on a wall.

The picture back is made in the traditional manner; however; it has holes or fixtures to hold a cord such that it can make two loops along the left side or along the top of the back. The picture back also has three slots for the easel holder to slip into. This allows the easel flap and the easel holder to be removed when the picture is going to be hung on a wall instead of sitting on a surface. The easel flap and easel holder are used for supporting the picture when it is in a tilted position on a surface. The removal of this easel flap and the holder make it easier to hang the picture onto a wall. The easel flap has two beveled edges for supporting the picture in either the narrow or wide directions when the picture is on a surface. The easel flap fits into one end of the easel holder and has two holes equidistant from a notch along a top edge of the easel. This notch and the holes are used to provide aligning holes for the screws that hold the picture onto a wall. The other end of the easel holder fits into the center slot of the picture back when it is supporting the picture on a surface.

When the picture is on a wall the easel holder is taken out of the center slot and put into a storage slot that is on the bottom of the picture. Two storage slots are provided in the picture back on the sides opposite the cord loops. The slot used depends upon the direction the picture is hung. The easel flap is removed from the holder and it is used as a locating template. The top notch is positioned under the desired center location of the picture on the wall. The two holes on either side of this notch are at the correct location for the support screws. The screws are placed into the holes and screwed into the wall so that their heads protrude slightly from the easel flap. These screws are now positioned to match the cord loops on the picture back.

When the picture is hung on the two screws the cord loops can be adjusted to make the picture perfectly level. Because they are connected together the loops work together in leveling the picture. That is, as one loop is made shorter the other loop becomes correspondingly longer.

When the picture is hung on a wall the easel flap is on the wall and the easel flap holder is in the bottom storage slot. The combination of these items holds the picture level and parallel to the wall. Additionally, all of the components are being used and available for switching from being on a wall to being on a surface.

DETAILED DESCRIPTION OF THE INVENTION

An easel picture back that can be used with any number of picture frames and provides a stable wall hanging as well as surface support is described.

Figure 1A:
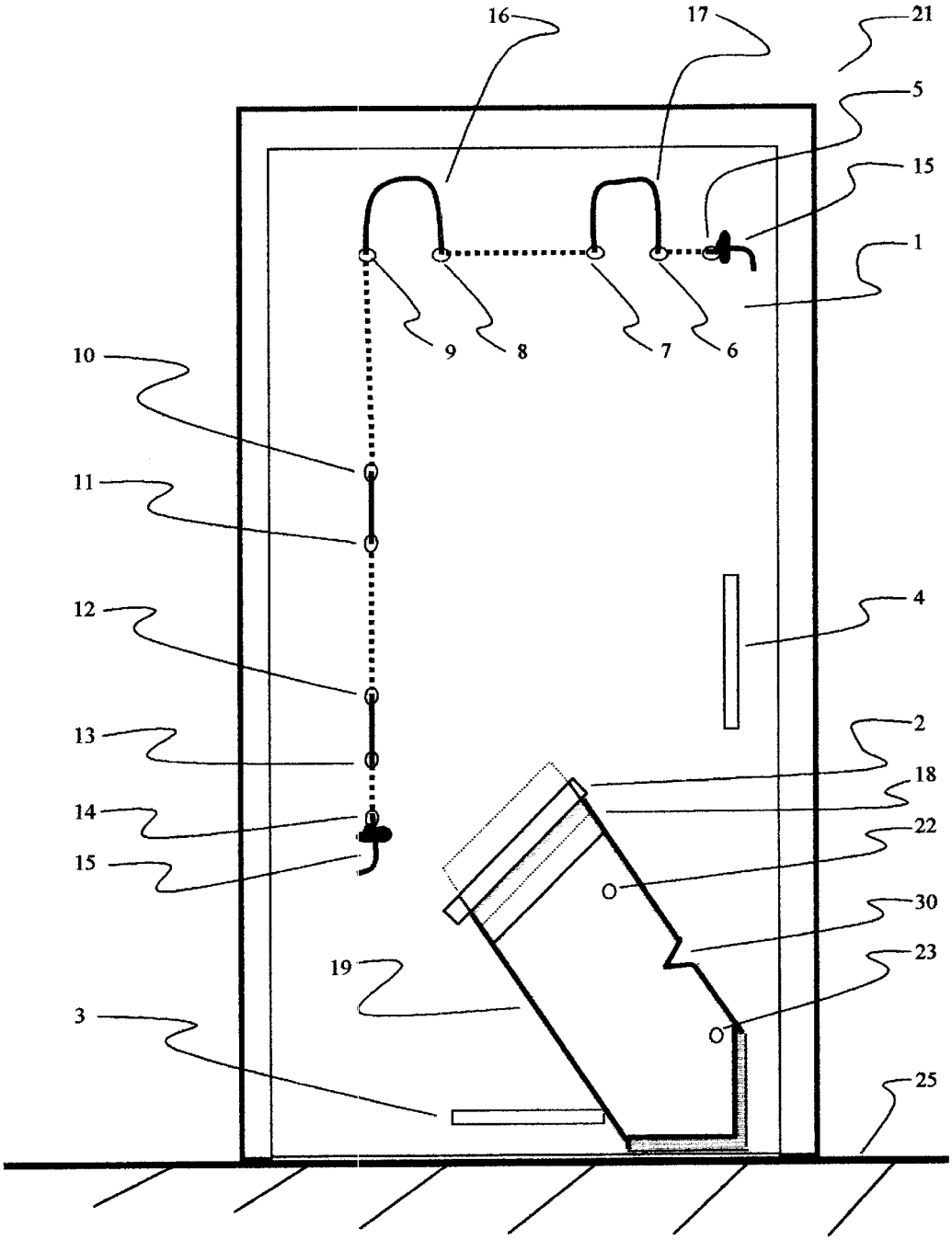
FIG. 1*a* is a back view of the back inserted into a picture frame.

With reference to FIGS. 1*a,* 1*b,* 1*c* & 1*d,* in which like numerals represent like parts, FIG. 1*a* shows picture back 1 slid into picture frame 21 and supported on surface 25. Picture back 1 has slots 2, 3 & 4 and holes 5–14. Cord 15 is knotted and goes in succession into and out of the holes 5–14. It is knotted and starts at 5 and goes through the top holes then down through the left side holes. Cord 15 exits hole 14 where it is knotted. Slack in cord 15 is pulled up through holes 8 & 9 and forms loop 16. Additional slack in cord 15 is used at 6 & 7 to form loop 17. Changing the length of cord 15 changes the total length available for loops 16 and 17. Loops 16 & 17 are used for hanging the picture on a wall and vertical positioning is accomplished by changing the length of cord 15 between holes 5 & 14. Slots 3 & 4 are in the middle of the bottom and on the right side of picture back 1. They are used to store easel holder 18 when the picture 21 is hung on a wall. Slot 2 is in an angular position some distance above slot 3. Slot 2 holds easel holder 18. Easel holder 18 fits into slot 2 on one end and holds easel flap 19 on the other end. Easel flap 19 extends away from picture back 1 and has a beveled portion that rests against surface 25 to hold picture 21 in a tilted position. Easel flap 19 has a notch 30 and holes 22 & 23 that are equidistant from notch 30. The distance between holes 22 & 23 corresponds to the distance between the center of loops 16 & 17.

Figure 1B:
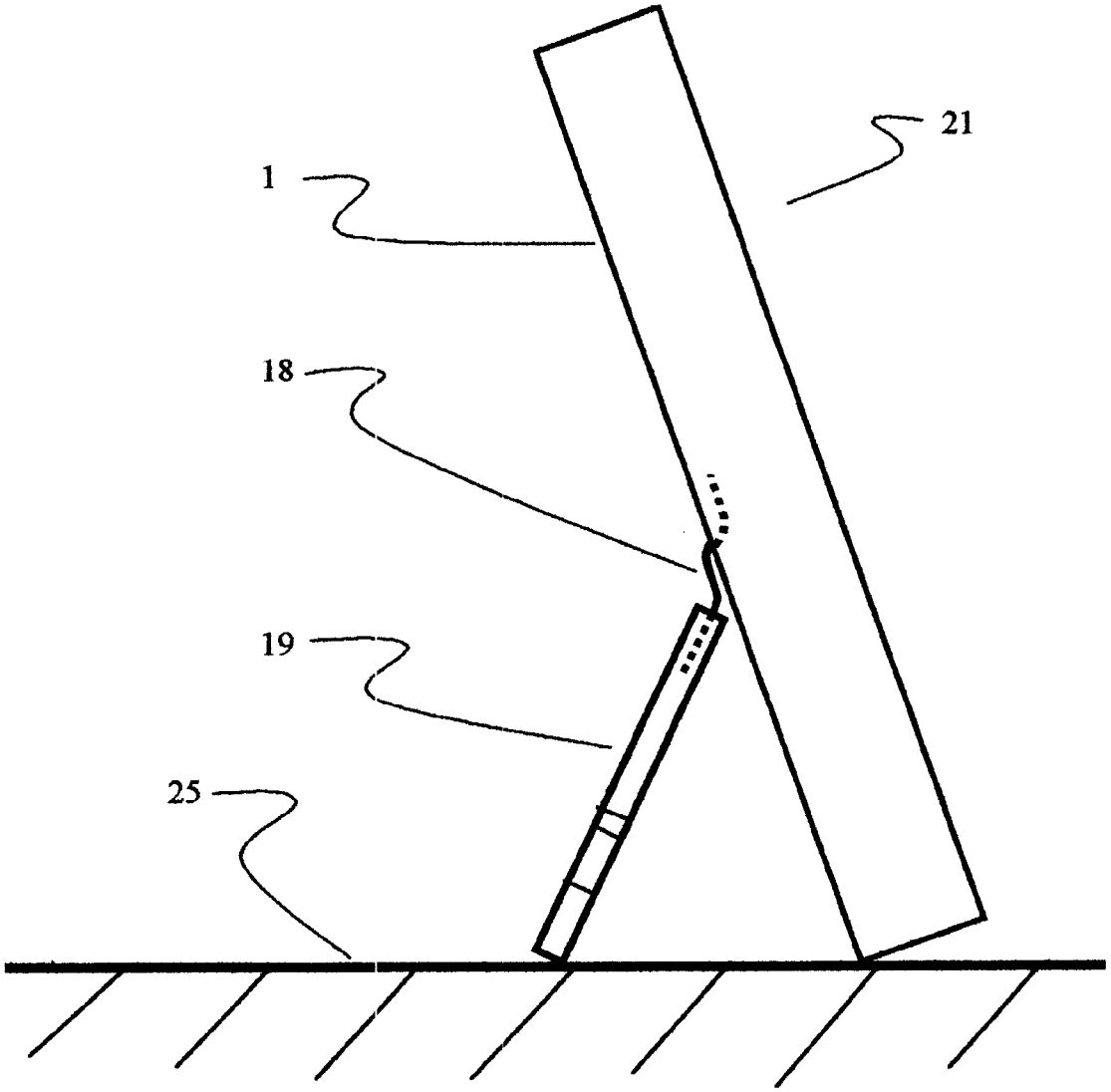
FIG. 1*b* is side view of the picture supported by the easel at an angle on a surface.

With reference to FIG. 1*b* cord holder 18 holds easel flap 19 on one end and fits into slot 3 of picture back 1. The easel flap 19 is supporting the picture 21 on surface 25 such that the bottom of the inclined picture frame 21 and easel flap 19 are resting on surface 25.

Figure 1C:
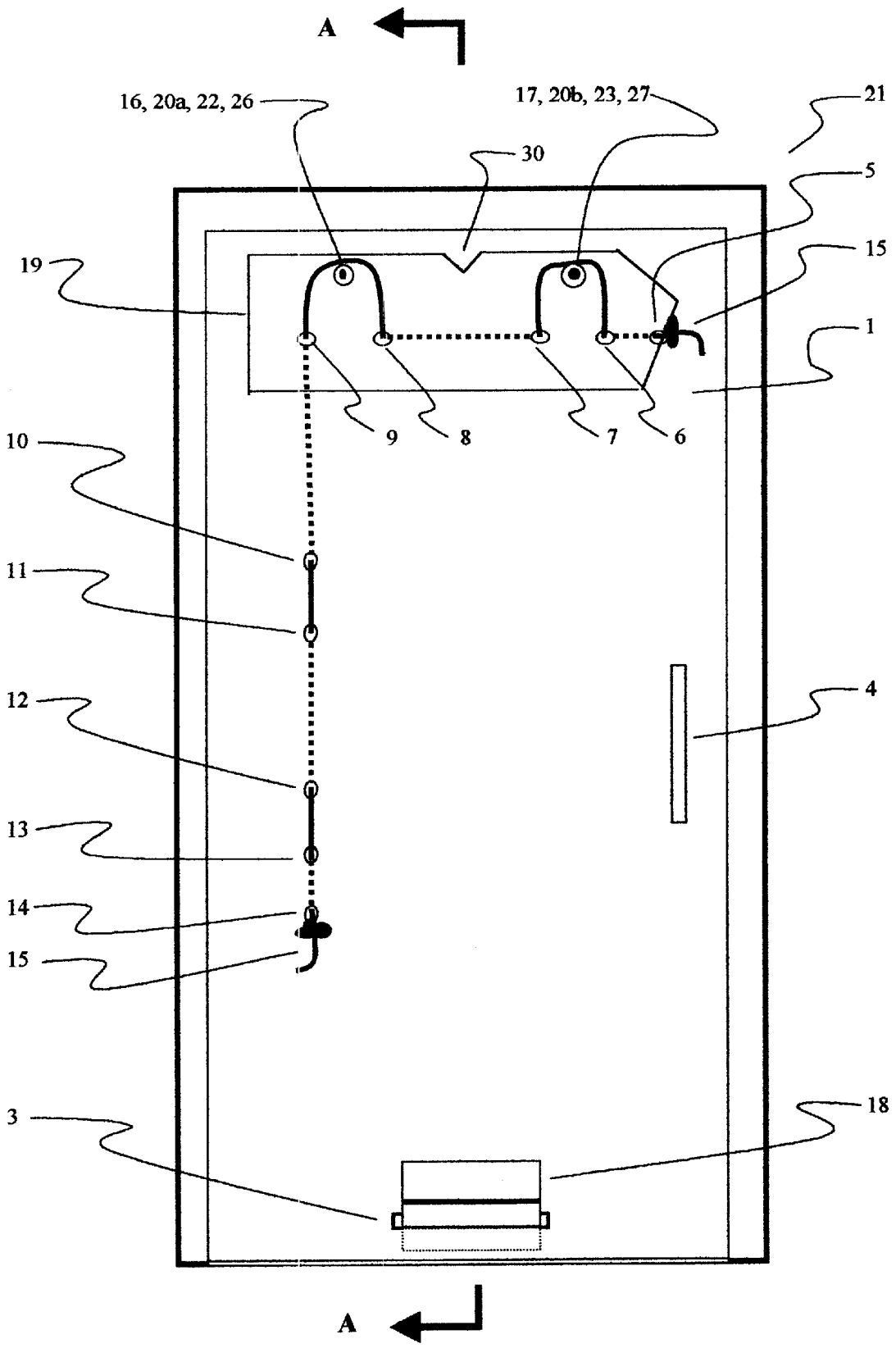
FIG. 1*c* is a view looking away from a wall toward the back of a picture attached to a wall.

With reference to FIG. 1*c,* screws 20*a*&*b* are through holes 22 & 23 in the easel flap 19 and extend into wall 24. The head of screws 20*a*&*b* are extending beyond the edge of easel flap 19 and form spaces 26 & 27. When the picture 21 is hung on the wall 24 the cord loops 16 & 17 are placed over screws 20*a*&*b* on spaces 26 & 27, and cord holder 16 is in storage slot 3. When the picture is hung in the other direction on wall 24 the cord holder 18 is in slot 4, and the cord loops 16 & 17 are between holes 10 & 11, and 12 & 13.

Figure 1D:
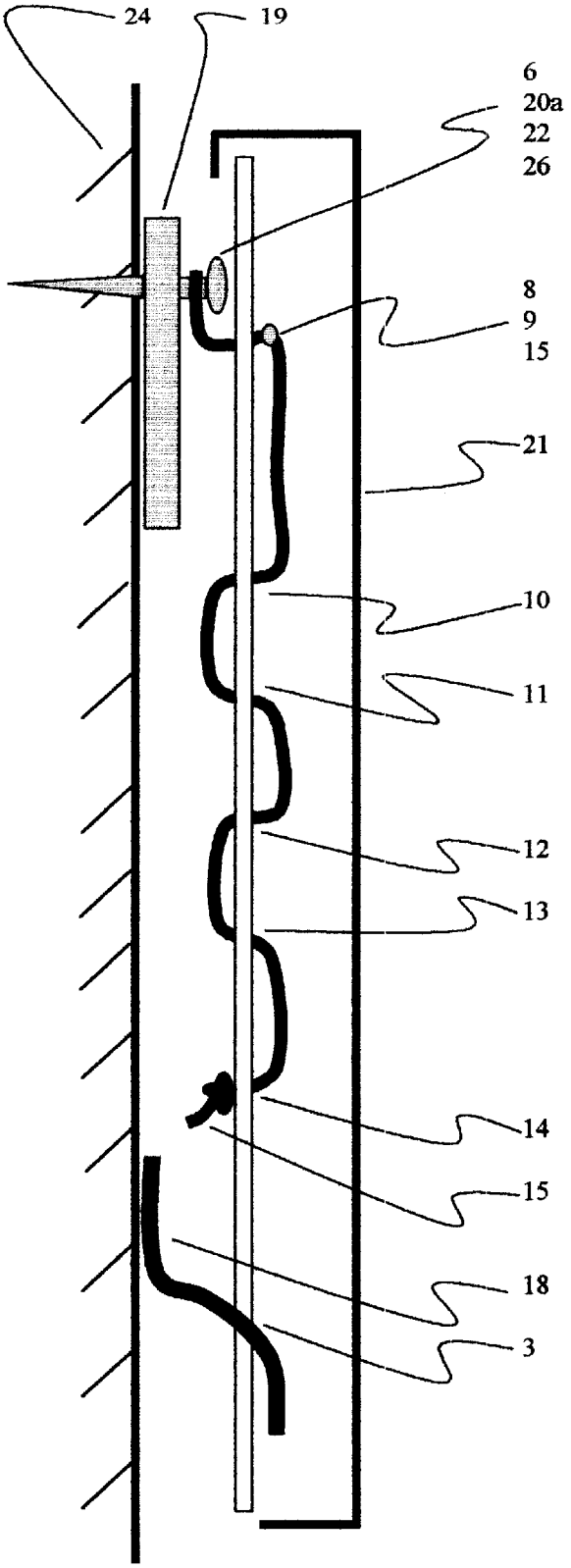
FIG. 1*d* is a vertical section of FIG. 1*c*.

With reference to FIG. 1*d,* picture 21 is hung on wall 24 by placing cord loop 16 over screw 20*a.* Screw 20*a* is screwed into wall 24 and is through hole 22 of easel flap 19. The cord loop 16 fits onto screw 20*a* in space 26 formed by the screw head and the easel flap 19. The cord 15 is knotted at hole 14 and threaded in succession through hole 8. By shortening or lengthening cord 15 the picture 21 can be raised or lowered as cord loop 16 is either shortened or lengthened. Easel holder 18 is shown in slot 3 and against wall 24.

While the invention has been described above with respect to certain embodiments thereof, it will be appreciated that variations and modifications may be made without departing from the spirit and scope of the invention. Some of these are the use of only top cord loop positions, the elimination of the easel, or the inclusion of the "back" directly into the picture.

What is claimed is:

1. A picture display device comprising a flexible cord forming a plurality of adjustable interconnected hanging loops for slidingly engaging two or more hooks affixed to a wall; the picture display device has a picture back configured to be attached to the picture display device, said back having a series of apertures there-through in which the flexible cord is threaded, said cord being affixed to the back at at least one end thereof and forming the adjustable loops between pairs of adjacent apertures such that the loops are used for engaging the two or more hooks affixed to a wall.

2. The picture display device of claim 1 further comprising a removable easel flap on the picture back for holding the picture display device on a flat surface.

3. The picture display device of claim 2 wherein the easel flap has two holes and a center notch for use as a template for locating support devices on a wall.

4. The picture display device of claim 1, wherein the back is further configured to have a means for inserting and removing a picture without removing the back.

* * * * *